US008864402B2

(12) United States Patent
Vila

(10) Patent No.: US 8,864,402 B2
(45) Date of Patent: Oct. 21, 2014

(54) REFILLABLE TOOTHBRUSH AND BASE ASSEMBLY

(76) Inventor: Luis Vila, Hialeah, FL (US)

( * ) Notice: Subject to any disclaimer, the term of this patent is extended or adjusted under 35 U.S.C. 154(b) by 317 days.

(21) Appl. No.: 13/424,377

(22) Filed: Mar. 20, 2012

(65) Prior Publication Data

US 2013/0251438 A1 Sep. 26, 2013

(51) Int. Cl.
*A46B 11/04* (2006.01)

(52) U.S. Cl.
USPC ..... 401/277; 401/101; 401/175; 401/131

(58) Field of Classification Search
USPC ..... 401/270, 277, 279, 282, 290, 171, 172, 401/175, 174, 75, 101, 131
See application file for complete search history.

(56) References Cited

U.S. PATENT DOCUMENTS 3,734,118 A * 5/1973 Howard ..... 132/311
4,467,822 A * 8/1984 Blackwell ..... 401/175
5,382,107 A * 1/1995 Nian ..... 401/191
6,945,256 B2 * 9/2005 Earl ..... 132/311
7,399,133 B1 * 7/2008 Eversole ..... 401/123
8,496,393 B2 * 7/2013 Martin et al. ..... 401/282

* cited by examiner

*Primary Examiner* — David Walczak
(74) *Attorney, Agent, or Firm* — Ruben Alcoba

(57) ABSTRACT

A refillable toothbrush and base assembly having a handle assembly, a hinge assembly, a head assembly, brush assembly, a toothpaste cartridge assembly, and a base assembly. The brush assembly is removably mounted to the head assembly. When not in use, the refillable toothbrush assembly rests on the base. A hinge assembly is integrally mounted to the handle assembly. The toothpaste cartridge assembly includes a toothpaste cartridge with an end cap, a plunger and a plunger actuator having a knob. The brush assembly has an internal channel. Upon the rotation of the knob, the toothpaste is forced to travels through the toothpaste cartridge assembly to exit at the brush. A user may rotate the head assembly, with the brush assembly mounted thereto, to a position where the brush assembly is housed within a channel and a cavity disposed at the handle assembly.

6 Claims, 6 Drawing Sheets

REFILLABLE TOOTHBRUSH AND BASE ASSEMBLY

BACKGROUND OF THE INVENTION

1. Field of the Invention

The present invention relates to toothbrushes, and more particularly, to refillable toothbrushes and base assemblies.

2. Description of the Related Art

Applicant believes that one of the closest references corresponds to U.S. Pat. No. 6,735,803 B2 issued to Kuo on May 18, 2004 for an electrical dentifrice-dispensing toothbrush with replaceable bristle unit and refillable cartridge. However, it differs from the present invention because Kuo teaches an electrical dentifrice dispensing toothbrush using a replaceable bristle unit with a permanent drive head and handle. The replaceable bristle unit consists of a rotary bristle element and a stationary bristle element that has an opening for the flow of dentifrice material through the drive head. The bristle unit is snap-on latched to the sidewalls of the drive head. Opposing tabs, which also function as pressure sensors on the bristle unit, are pressed toward each other to release the bristle unit. A linkage is used to convert the rotation of the drive shaft to a planar oscillation that enables a compact drive head configuration. The dentifrice dispensing is accomplished by using a rotary solenoid for actuating an internal button that applies pumping pressure to the dentifrice material. As a benefit to arthritis suffers, no external squeezing action is involved.

Applicant believes that another reference corresponds to U.S. Pat. No. 5,321,866 B1 issued to Klupt on Jun. 21, 1994 for a toothbrush system. However, it differs from the present invention because Klupt teaches a toothbrush system, which includes a handle member (14), which defines an internal handle chamber (22) for containment therein of a cleansing liquid container (28). The handle member (14) is coupled to a head housing (24), which has bristles (20) extending from it. The bristles (20) are displaceably oscillated about a central axis (16) and simultaneously are rotated about an axis, which extends in a perpendicular direction to the longitudinal direction (18) and is responsive to the oscillating displacement of the bristles (20). A mechanism is provided for delivering a liquid from the handle (14) through the head member (12) and external the toothbrush system adjacent the bristles (20). In this manner, there is provided pulsating liquid flow from the toothbrush system with a combined rotation and oscillation of the toothbrush bristles (20) in a plurality of planes.

Applicant believes that another reference corresponds to U.S. Pat. No. 6,575,203 B2 issued to Hall et al., on Jun. 10, 2003 for a fluid dispensing and refilling system for a power toothbrush. However, it differs from the present invention because Hall et al. teach a fluid delivery/refilling system, which includes a unit-of-use fluid reservoir for dentifrice or medication within a head portion of a power toothbrush, which is removable from the remainder thereof. A pump element is located in the brush head and is configured so that the back and forth movement of the brush head in operation results in fluid moving from the reservoir to a dispensing valve located in the brush head. The dispensing valve has an end portion, which is normally closed, opening under pressure of fluid from the pump. The refilling assembly is separate from the toothbrush and is configured to fit over the top of the toothbrush. Upward pressure exerted on the toothbrush when the toothbrush is within the refilling assembly results in movement of a core element in the refilling assembly, which in turn results in a hollow needle in the refilling assembly extending into a refiller valve in the head portion of the toothbrush. This results in a fluid path between the refilling assembly and the reservoir in the toothbrush. A selected sequence of movement of the toothbrush relative to the refilling results in fluid being moved from the external reservoir through the needle into the on-board unit-of-use reservoir in the toothbrush.

Applicant believes that another reference corresponds to U.S. Pat. No. 6,164,967 B1 issued to Sale et al. on Dec. 26, 2000 for a fluid delivery dental cleaning device. However, it differs from the present invention because Sale et al. teach a fluid delivery powered toothbrush, which utilizes a removable/disposable neck assembly that contains a fluid reservoir, a fluid delivery 1 system and a fluid path therein leading to a brush receptacle. No fluid is used in or passes through the toothbrush handle. Preferably a pump is located in the neck assembly and activated at the same time as the brush drive such that fluid is delivered during brushing. In one embodiment, the brush is replaced with a nozzle for providing fluid prior to or after brushing. The components for the neck assembly are disposable to minimize cross contamination while enhancing fluid delivery to the teeth during brushing.

Applicant believes that another reference corresponds to U.S. Pat. No. 6,648,641 B1 issued to Viltro, et al. on Nov. 18, 2003 for an Apparatus, method and product for treating teeth. However, it differs from the present invention because Viltro, et al. teach a brushing system including a multiple cartridge dispensing system, which dispenses the treatment material either directly onto brush bristles, or through the brush to the bristles. A multiplicity of materials may be provided to the cartridges for use in brushing. In addition to use in dental care, the system finds utility in hair coloring, spot laundry cleaning, skin and nail care, and polishing, as well as numerous others.

Applicant believes that another reference corresponds to U.S. Pat. No. 2,766,472 B1 issued to Durrett on Oct. 16, 1956 for Fountain Toothbrush. However, it differs from the present invention because Durrett teaches a toothbrush comprising a horizontally elongated head having bristles on a lower surface. The head includes a longitudinal circular bore terminating at its inner end in an enlarged annular recess. The bore includes a plurality of radially disposed discharge openings extending through the lower surface providing communication with the bore. A tubular nozzle received in the bore has an annular shoulder at one end rotatably received in the enlarged recess of the circular bore. The nozzle includes radial apertures that selectively register with the radial discharge openings in the head. The nozzle terminates in an annular enlarged collar at the end opposite the enlarged annular shoulder. The head has an end surface abutting the adjacent surface of the annular collar. A projection on the annular collar extends toward the end surface of the head and a detention on the end surface of the head engage upon rotation with the projection to latch the head and nozzle in a fixed position wherein the discharge openings in the head and the apertures registers therewith in the nozzle are out of communication.

Applicant believes that another reference corresponds to U.S. Pat. No. 5,636,933 B1 issued to Vizsolyion Jun. 10, 1997 for a travel toothbrush with incremental toothpaste dispenser. However, it differs from the present invention because Vizsolyi teaches a travel toothbrush with incremental toothpaste dispenser comprising: a main housing with open inboard and outboard ends, the main housing having an inner surface with diametrically spaced detents, a toothbrush having a brush head and a reservoir affixed to the open inboard end of the main housing, 1 the brush head having a base including a plurality of bristles and a central channel extending therein, the channel being in communication with the reservoir, a plurality of bores being positioned in the base and in communication with the central channel; and a plunger formed in an elongated configuration with inboard and outboard ends, a rubber piston being rotatably coupled to the inboard end, the plunger having an outer surface including a plurality of diametrically opposing pairs of indents, the plunger being positioned within the main housing with indents being coupled to detents of the main housing to lock the plunger in a stable orientation, in operation the main housing being filled with toothpaste and a user pressing the plunger to force toothpaste onto the bristles.

Other patents describing the closest subject matter provide for a number of more or less complicated features that fail to solve the problem in an efficient and economical way. None of these patents suggest the novel features of the present invention.

SUMMARY

The instant invention is a refillable toothbrush and base assembly.

It is therefore one of the main objects of the 1 present invention to provide a refillable toothbrush and base assembly that comprises a head assembly that is hingedly mounted onto a handle assembly.

It is another object of this invention to provide a refillable toothbrush and base assembly comprising a handle assembly that houses a toothpaste cartridge assembly that dispenses a predetermined amount of toothpaste upon actuating a knob.

It is another object of this invention to provide a refillable toothbrush and base assembly that can be used with different head types including: brush assemblies, tongue scrapers, or floss.

It is another object of this invention to provide a refillable toothbrush and base assembly that comprises a head assembly, a handle assembly and a base assembly. The head assembly dispenses toothpaste from the toothpaste cartridge assembly housed within the handle assembly.

It is another object of this invention to provide a refillable toothbrush and base assembly that is volumetrically efficient for carrying, transporting, and storage.

It is another object of this invention to provide a refillable toothbrush and base assembly that can be readily assembled and disassembled without the need of any special tools.

It is another object of this invention to provide a refillable toothbrush and base assembly, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

DRAWINGS

With the above and other related objects in view, the invention consists in the details of construction and combination of parts as will be more fully understood from the following description, when read in conjunction with the accompanying drawings in which.

DESCRIPTION

Figure 1:
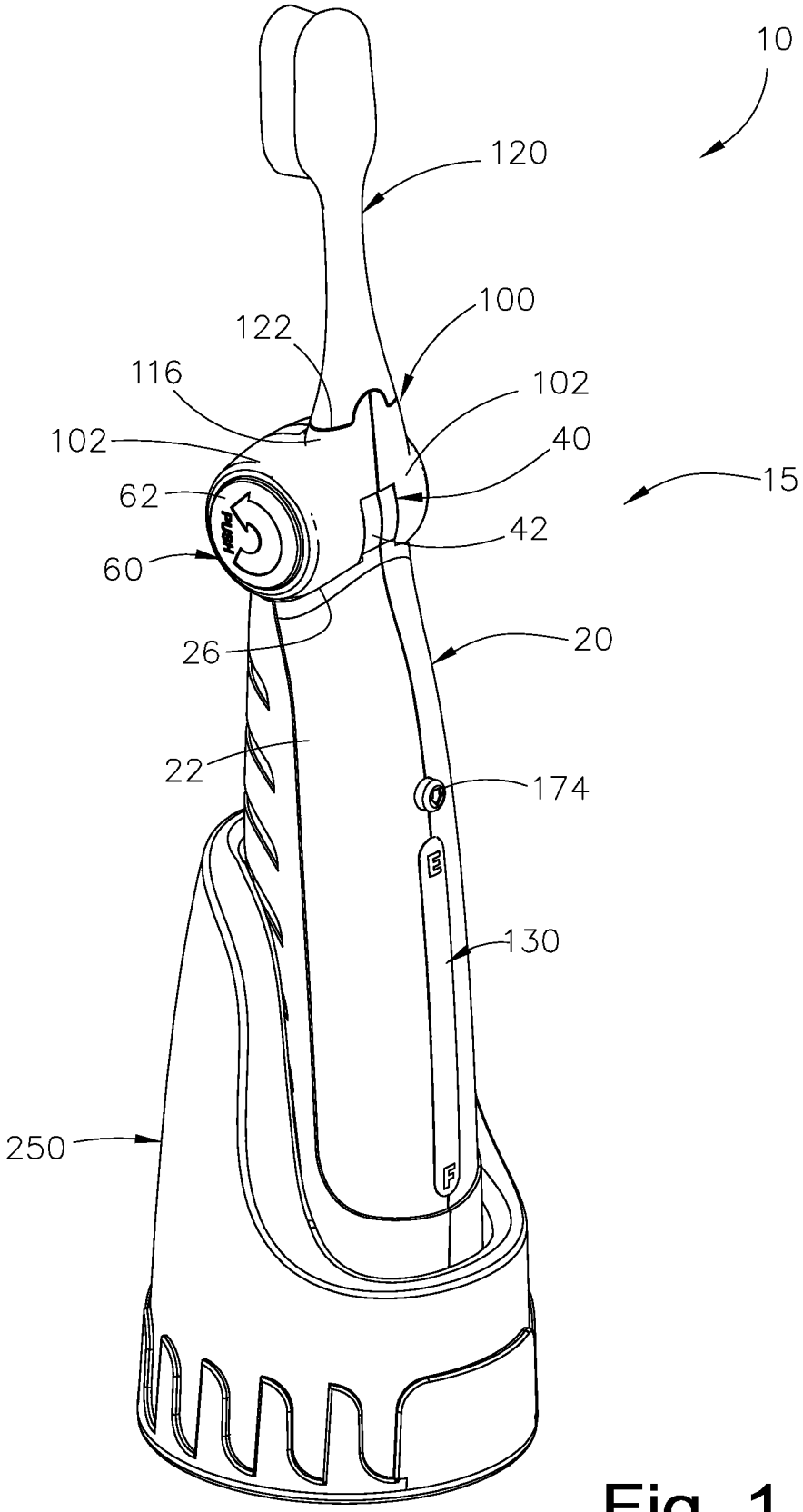
FIG. 1 represents an isometric view of a refillable toothbrush mounted upon its base assembly, object of the present invention.

Referring now to the drawings, the present invention is generally referred to with numeral 10. It can be observed that it basically includes handle assembly 20, hinge assembly 40, head assembly 100, brush assembly 120, toothpaste cartridge assembly 200, and base assembly 250.

As seen in FIG. 1, refillable toothbrush 15 is mounted upon its base assembly 250. Brush assembly 120 is removably mounted to head assembly 100.

Figure 2:
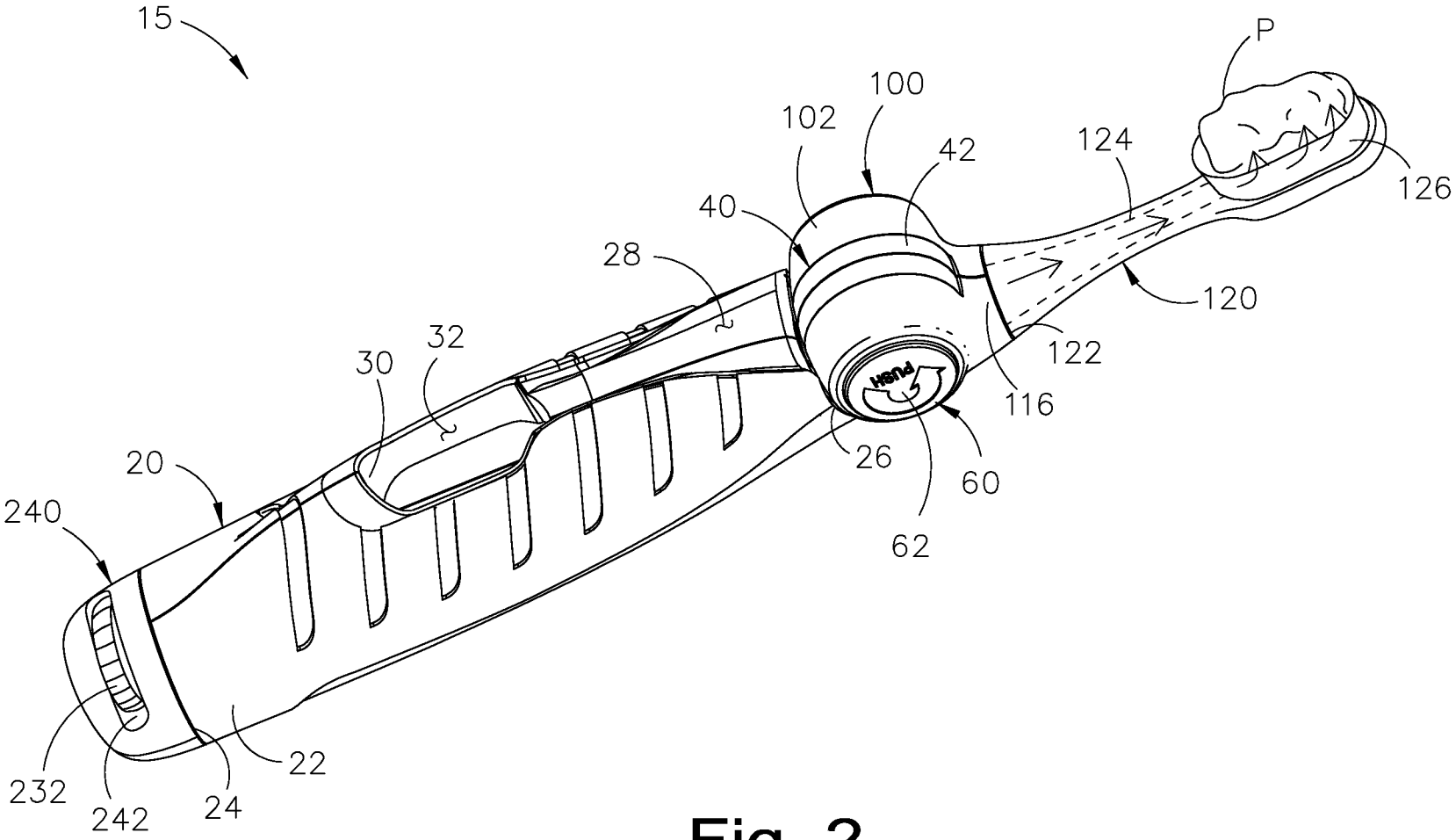
FIG. 2 is an isometric view of the refillable 1 toothbrush in an extracted configuration with its brush assembly dispensing toothpaste.

As seen in FIG. 2, handle assembly 20 is ergonomically shaped in a preferred embodiment. In addition, handle assembly 20 may have gripping aids including surface markings and/or material thereon to improve gripping. Handle assembly 20 comprises sidewall 22 with ends 24 and 26. Channel 28 extends longitudinally a predetermined distance from end 26 at one side of sidewall 22. Cavity 32 extends from channel 28 to end 30. Channel 28 and cavity 32 partially receive brush assembly 120 when in a retracted configuration. Hinge assembly 40 is integrally mounted to end 26 of handle assembly 20. End 26 is common to hinge assembly 40 and handle assembly 20. Brush assembly 120 has open end 122. Extending internally from open end 122 is channel 124 that represented in dotted lines. Toothpaste P, from toothpaste cartridge assembly 200, seen in FIGS. 4 and 5, travels through channel 124 to exit at brush 126.

Figure 3:
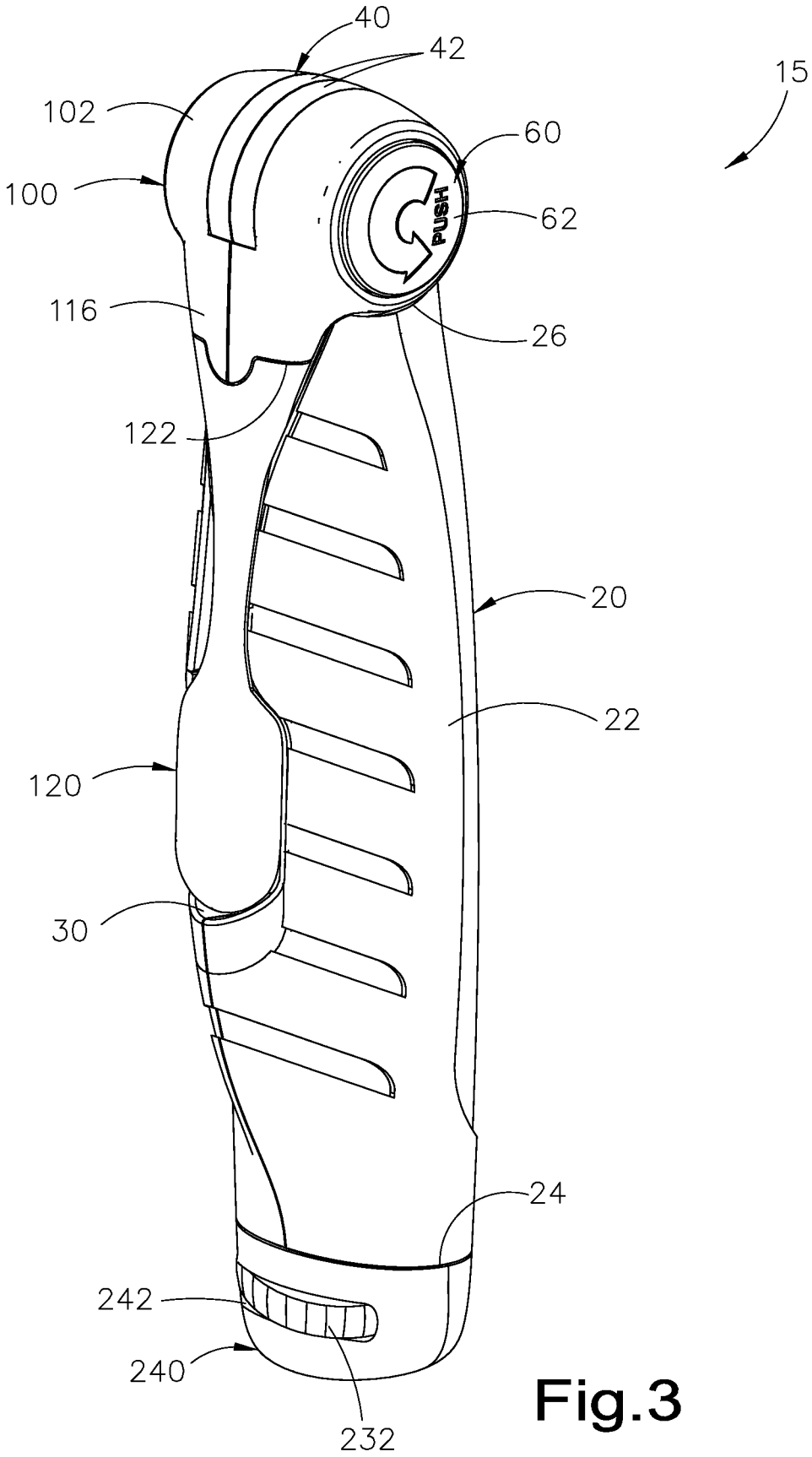
FIG. 3 is an isometric view of the head assembly in a retracted configuration.

As seen in FIG. 3, when not in use, head assembly 100 may be placed in the retracted configuration, whereby channel 28 and cavity 32, seen in FIG. 2, partially receive brush assembly 120.

Figure 4:
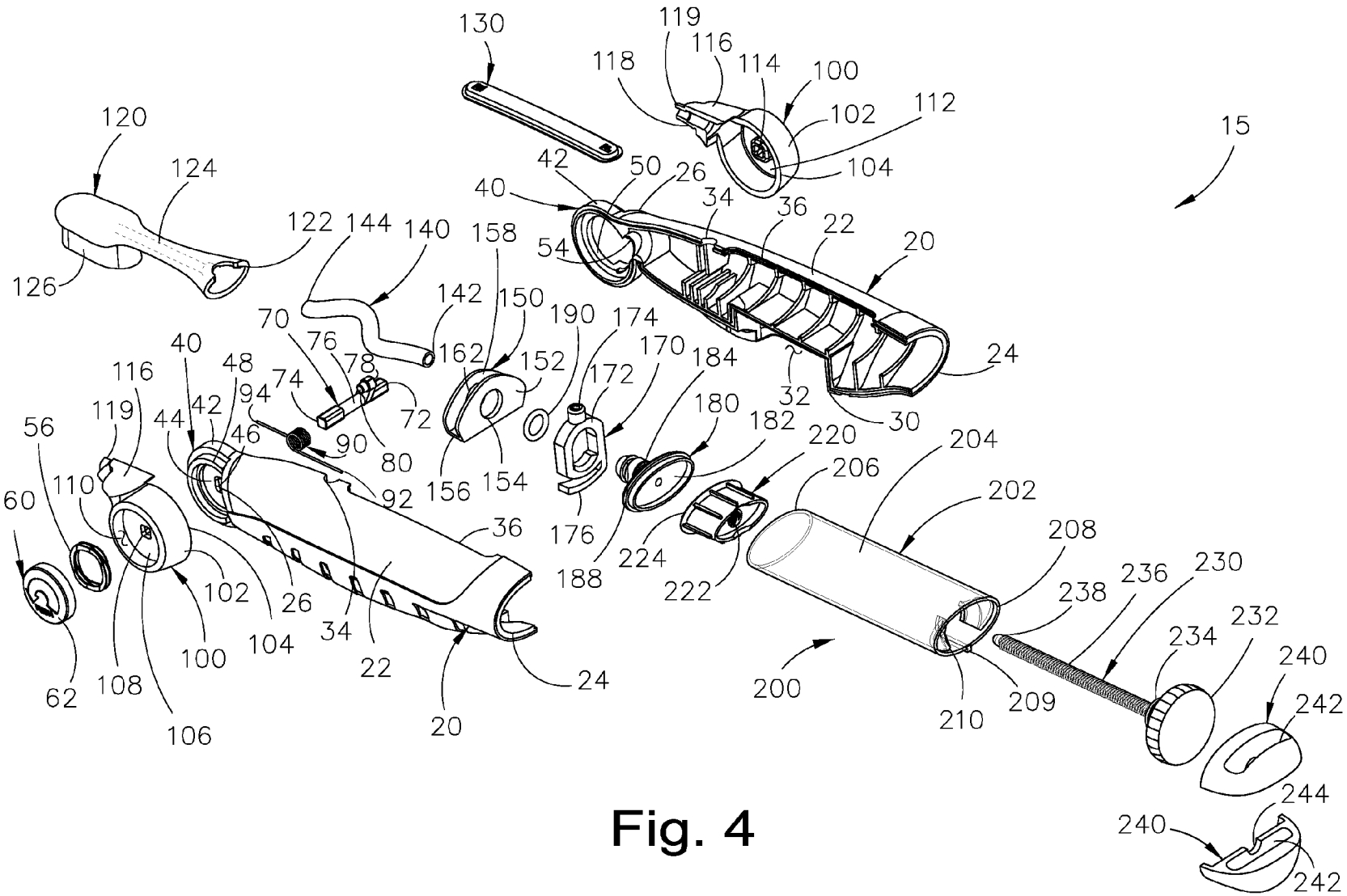
FIG. 4 is a first exploded view of the refillable toothbrush.
Figure 5:
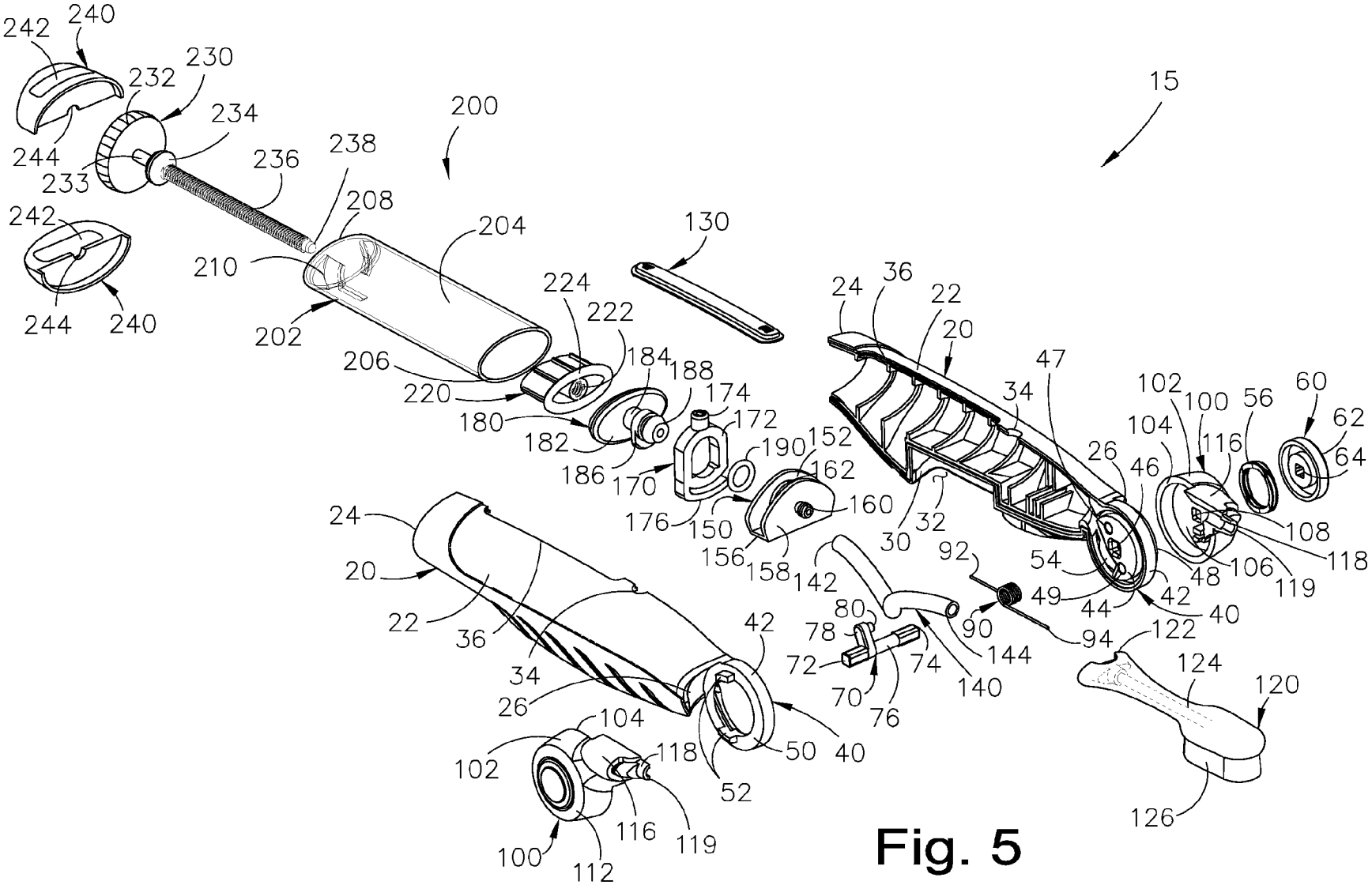
FIG. 5 is a second exploded view of the refillable toothbrush.

As seen in FIGS. 4 and 5, handle assembly 20 has interior transversal ribs. Handle assembly 20 further comprises through hole 34 and slot 36, both disposed on sidewall 22 opposite to channel 28 and cavity 32. Through hole 34 is positioned at a predetermined distance from end 26. Slot 36 is adjacent to through hole 34. Slot 36 longitudinally extends a predetermined distance toward end 24, without reaching end 24.

Hinge assembly 40 comprises exterior edges 42. A first exterior edge 42 comprises interior wall 44 and peripheral wall 48. Interior wall 44 has through hole 46 and locking holes 47 and 49. Holes 47 and 49 are opposite to each other and align with through hole 46. The first exterior edge 42 has channel 54 internally defined. A second exterior edge 42 comprises ring 50 with protrusions 52. Protrusions 52 are opposite to each other and are cooperatively disposed with the position of locking holes 47 and 49.

Head assembly 100 is mounted onto hinge assembly 40 and comprises exterior walls 102 with corresponding interior edges 104. A first exterior wall 102 has interior wall 106 defining exterior cavity 110, best seen in FIG. 4. Interior wall 106 has through hole 108. A second exterior wall 102 has sidewall 112. Protruding from an interior of sidewall 112 is aperture 114. Extending from exterior walls 102 are bases 116, which have connectors 118 internally defined. Connectors 118 have cooperative dimension and shape to snugly receive end 144 of connecting tube 140 therein. Connectors 118 have male ends 119 that are removably secured into open end 122 of brush assembly 120.

Actuating pin 70 comprises ends 72 and 74, shaft 76, and arm 78. Ends 72 and 74, and their adjacent portions, have a non-circular cross-section. Shaft 76 has a circular cross section and extends from a non-circular portion of end 72 to a non-circular portion of end 74. Arm 78 extends perpendicularly from shaft 76 at a predetermined distance from end 72. Protrusion 80 extends perpendicularly from a distal end of arm 78 toward end 74.

As best seen in FIG. 4, actuating button 60 is mounted within exterior cavity 110 of head assembly 100. Actuating button 60 has face 62. Aperture 64, best seen in FIG. 5, is interiorly defined in actuating button 60. Circular spring 56 is also disposed within cavity 110 between interior wall 106 and actuating button 60 to bias them apart from each other.

Aperture 114 is of a cooperative shape and dimension to receive end 72. Through hole 108 is also of a cooperative shape and dimension to receive end 74 therethrough. When assembled, end 74 passes through hole 46, through hole 108 and engages into aperture 64. End 72 engages into aperture 114. Protrusion 80 cooperatively engages into locking hole 47 when head assembly 100 and brush assembly 120 are in the extracted configuration shown in FIG. 2. When actuating button 60 is pressed, protrusion 80 is released from locking hole 47, permitting a user to apply a force of a predetermined magnitude to overcome a tension of spring 90 to rotate head assembly 100 and brush assembly 120 to the retracted configuration shown in FIG. 3. In the retracted configuration, protrusion 80 cooperatively engages into locking hole 49. Protrusions 52, cooperatively disposed with locking holes 47 and 49, limit the rotational movement of head assembly 100.

Spring 90 mounts upon actuating pin 70, between hinge assembly 40 and head assembly 100. Specifically, spring assembly 90 is partially housed between interior wall 44 and interior wall 106, surrounded by peripheral wall 48. Spring assembly 90 has ends 92 and 94. End 92 is secured to end 26, and end 94 is interiorly secured to base 116.

Brush assembly 120 has open end 122. Extending internally from open end 122 is channel 124. Adjacent to open end 122, a predetermined portion of channel 124 has a cooperative shape and dimension to receive male ends 119. Brush assembly 120 is removable from head assembly 100 upon the application of a force of predetermined magnitude.

Transparent indicator 130 is mounted to slot 36. Through transparent indicator 130, the user can see the amount of remaining paste P inside toothpaste cartridge assembly 200. As an example, transparent indicator 130 may also have markings "F" and "E" to indicate when toothpaste cartridge assembly 200 is full or empty.

Adapter 150 is kept in place by the internal transversal ribs of handle assembly 20. Adapter 150 comprises walls 152 and 158, and base 156. In the preferred embodiment, walls 152 and 158 are substantially parallel and kept spaced apart from each other by base 156. Wall 152 has hole 154, seen in FIG. 4. Extending from hole 154 into wall 158 is funnel 162, which ends with nipple 160 seen in FIG. 5, protruding from wall 158.

Connecting tube 140 has ends 142 and 144. End 142 is secured to nipple 160 of adapter 150. Channel 54, of first exterior edge 42, cooperatively receives and secures in place a portion of connecting tube 140. Then, connecting tube 140 passes through ring 50. Connectors 118, have interior cooperative dimension and shape to snugly receive and secure end 144 therein.

Latch 170 is also kept in place by the internal transversal ribs of handle assembly 20 next to adapter 150. Latch 170 comprises frame 172 with protrusion 174, and spring arm 176. Protrusion 174 goes through through hole 34.

Toothpaste cartridge assembly 200 comprises toothpaste cartridge 202, end cap 180, plunger 220 and plunger actuator 230.

Toothpaste cartridge 202 comprises exterior wall 204 with ends 206 and 208. Angled wall 210 is defined inside exterior wall 204 adjacent to end 208. Toothpaste cartridge 202 is a container for toothpaste P, shown in FIG. 2. In the preferred embodiment, exterior wall 204 is made of a transparent material, so the amount of toothpaste P contained therein can be seen through transparent indicator 130. Toothpaste cartridge 202 further comprises alignment tab 209.

End cap 180 is mounted to end 206. End cap 180 comprises base 182. Protruding from base 182 is shaft 184 with locking member 186 and nipple 188. Shaft 184 goes through latch 170, with nipple 188 passing through hole 154 to engage into funnel 162. O-ring 190 is mounted to shaft 184 between locking member 186 and nipple 188 to seal a junction with funnel 162. When mounted, locking member 186 engages upon a lower portion of frame 172.

Plunger 220 is inserted through end 206 inside toothpaste cartridge 202. In an initial position, wherein toothpaste cartridge 202 is full of toothpaste P, plunger 220 rests against angled wall 210. Plunger 220 comprises threaded hole 222 and base 224.

Plunger actuator 230 comprises knob 232 with shaft 233 and contiguous driver 234. Extending from driver 234 is threaded shaft 236 with end 238. Driver 234 cooperatively engages into angled wall 210. Threaded shaft 236 passes through angled wall 210 and threaded hole 222.

Cap 240 mounts upon knob 232. Cap 240 comprises slots 242 and central hole 244. Cap 140 has cooperative dimensions and shape to house knob 232 therein, and partially protrude through slots 242. Shaft 233 pass though central hole 244.

The user rotates the portions of knob 232 that protrude from slots 242 to move plunger 220 inside toothpaste cartridge 202 toward end 206. In this way, toothpaste P is urged to go through nipple 188, funnel 162, nipple 160, connecting tube 140, and exits at brush 126 as seen in FIG. 2.

Toothpaste cartridge assembly 200 is replaceable. To replace toothpaste cartridge assembly 200 the user presses protrusion 174, urging latch 170 to be displaced, releasing locking member 186. Thus, permitting toothpaste cartridge assembly 200 to be removed through end 24. The user then inserts a new toothpaste cartridge assembly 200 while pressing protrusion 174. As toothpaste cartridge assembly 200 reaches the end, when nipple 188 is stopped by funnel 162, the user releases protrusion 174. Then, spring arm 176 pushes latch 170 up and locking member 186 engages onto the lower portion of frame 172.

Figure 6:
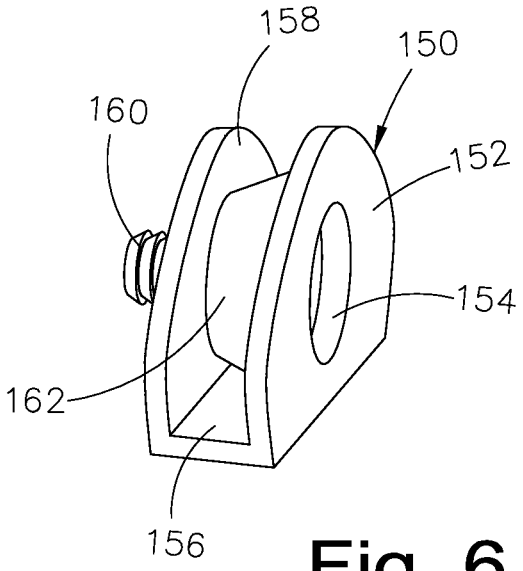
FIG. 6 is an enlarged isometric view of an adapter.

Seen in FIG. 6 is an enlarged representation of adapter 150 wherein walls 152 with hole 154, base 156, wall 158 with nipple 160, and funnel 162 can be best seen. Funnel 162 extends from wall 152 to wall 158.

Figure 7:
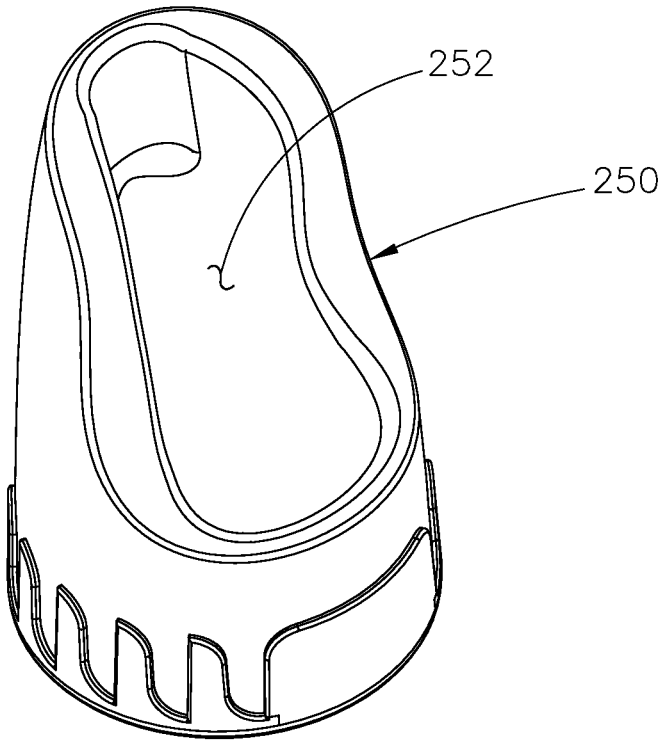
FIG. 7 is an isometric view of the base assembly.

As best seen in FIG. 7, base assembly 250 comprises cavity 252 that is cooperatively shaped and dimensioned to receive handle assembly 20. When not in use, refillable toothbrush 15 may rest or be stored on base assembly 250 as shown in FIG. 1.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A refillable toothbrush, comprising:

a handle assembly;

a hinge assembly mounted to said handle assembly;

a head assembly mounted onto said hinge assembly, said head assembly comprises bases having connectors internally defined;

a brush assembly removably mounted to said head assembly, said brush assembly has an open end, extending internally from said open end is a channel through which said toothpaste travels through to exit from said brush assembly;

a toothpaste cartridge assembly housed within said handle assembly, said toothpaste cartridge assembly stores toothpaste that exits from said brush assembly; and a connecting tube that receives said connectors, said connectors have male ends that are removably secured into said open end of said brush assembly.

2. A refillable toothbrush, comprising:

a handle assembly, said handle assembly comprises a sidewall with first and second ends, a channel extends longitudinally a first predetermined distance from said first end and a cavity extends from said channel towards said second end, a hinge assembly mounted to said handle assembly, said hinge assembly comprises a through hole and first and second locking holes, said first and second locking holes are opposite to each other and align with said through hole ;

a head assembly mounted onto said hinge assembly;

a brush assembly removably mounted to said head assembly;

a toothpaste cartridge assembly housed within said handle assembly, said toothpaste cartridge assembly stores toothpaste that exits from said brush assembly; and an actuating pin having first and second ends, a shaft, and an arm, said first and second ends of said actuating pin have a non-circular cross-section and said shaft has a cross-section and extends from said non-circular cross-section portion of said first end of said actuating pin to said non-circular cross-section portion of said second end of said actuating pin, said arm extends perpendicularly from said shaft at a predetermined distance from said first end of said actuating pin and a protrusion extends from a distal end of said arm toward said second end of said actuating pin.

3. The refillable toothbrush set forth in claim 2, further comprising an actuating button that is mounted within an exterior cavity of said head assembly.

4. The refillable toothbrush set forth in claim 3, further characterized in that pressing said actuating button causes said protrusion to be released from said first locking hole, permitting rotation of said head assembly and said brush assembly to a retracted configuration, in said retracted configuration, said protrusion cooperatively engages into said second locking hole.

5. A refillable toothbrush, comprising:

a handle assembly;

a hinge assembly mounted to said handle assembly;

a head assembly mounted onto said hinge assembly, said head assembly comprises bases having connectors internally defined;

a brush assembly removably mounted to said head assembly, said brush assembly has an open end, extending internally from said open end is a channel through which said toothpaste travels through to exit from said brush assembly;

a toothpaste cartridge assembly housed within said handle assembly, said toothpaste cartridge assembly stores toothpaste that exits from said brush assembly;

a connecting tube that receives said connectors, said connectors have male ends that are removably secured into said open end of said brush assembly; and an adapter comprising first and second walls that are substantially parallel and kept spaced apart from each other by a base, said first wall has a hole and extending from said hole into said second wall is a funnel, which ends with a nipple protruding from said second wall.

6. The refillable toothbrush set forth in claim 5, further characterized in that said connecting tube is secured to said nipple of said adapter.

* * * * *